US006453790B1

(12) United States Patent
Cesulka et al.

(10) Patent No.: US 6,453,790 B1
(45) Date of Patent: Sep. 24, 2002

(54) MUNITIONS SUCCESS INFORMATION SYSTEM

(75) Inventors: John L. Cesulka, Walton Beach; Kenneth J. Williamson, Crestview, both of FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 5 days.

(21) Appl. No.: 09/832,454

(22) Filed: Apr. 12, 2001

(51) Int. Cl.[7] ..... B64D 1/04

(52) U.S. Cl. ..... 89/1.11; 89/1.1; 102/473; 102/501; 102/293; 102/382

(58) Field of Search ..... 89/1.11, 1.1; 102/473, 102/501, 293, 382

(56) References Cited

U.S. PATENT DOCUMENTS

| | | | | |
|---|---|---|---|---|
| 3,435,457 | A | | 3/1969 | Brueckmann |
| 3,803,616 | A | | 4/1974 | Kopf et al. |
| 4,375,192 | A | | 3/1983 | Yates et al. |
| 4,448,106 | A | | 5/1984 | Knapp |
| 4,455,939 | A | | 6/1984 | Munzel |
| 4,480,550 | A | | 11/1984 | Abt |
| 4,580,498 | A | | 4/1986 | Abt et al. |
| 4,638,130 | A | | 1/1987 | Grossler |
| 4,667,598 | A | | 5/1987 | Grobler |
| 4,679,748 | A | | 7/1987 | Blomqvist et al. |
| 4,694,752 | A | | 9/1987 | Titus |
| 4,703,693 | A | | 11/1987 | Spies |
| 4,742,305 | A | | 5/1988 | Stolarczyk |
| 4,799,427 | A | | 1/1989 | Held et al. |
| RE33,458 | E | | 11/1990 | Stolarczyk |
| 5,064,151 | A | | 11/1991 | Cerimele et al. |
| 5,255,608 | A | | 10/1993 | Min |
| 5,339,742 | A | * | 8/1994 | Hulderman et al. ..... 102/213 |
| 5,467,681 | A | * | 11/1995 | Liberman ..... 244/3.1 |
| 5,537,909 | A | * | 7/1996 | Schneider et al. ..... 102/293 |
| 5,698,814 | A | | 12/1997 | Parsons et al. |
| 5,721,421 | A | | 2/1998 | VanDonkelaar |
| 5,793,889 | A | * | 8/1998 | Bushman ..... 244/3.16 |
| 5,829,519 | A | | 11/1998 | Uthe |
| 6,151,276 | A | | 11/2000 | Peinetti |
| 6,380,906 | B1 | * | 4/2002 | Cesulka ..... 342/2 |

* cited by examiner

*Primary Examiner*—J. Woodrow Eldred
(74) *Attorney, Agent, or Firm*—Gerald B. Hollins; Thomas L. Kundert

(57) ABSTRACT

A system for communicating hardened, buried target arrival-related data from an airborne warhead device to a remote mission analysis location is disclosed. The communicated information especially relates to impact deceleration events encountered by a hardened target penetration warhead, events arising from the warhead impacting with the earth and then with one or more layers of hardening material such as concrete disposed in or adjacent a subterranean target. Verification of warhead detonation may also be included in the communicated data. The system includes ultra high radio frequency communication from the subterranean warhead to a repeater apparatus disposed at or above the point of warhead earth impact followed by conventional signal relaying of the collected warhead experience data from the repeater to a remote mission analysis facility. Utilization of the system to verify effective neutralization of targets, even targets remaining visually obscured throughout an identification, strike and reconnaissance sequence, is disclosed along with the capability of such a system to limit the need for dangerous subsequent strikes against the same target.

24 Claims, 5 Drawing Sheets

MUNITIONS SUCCESS INFORMATION SYSTEM

CROSS REFERENCE TO RELATED APPLICATIONS

The present application is somewhat related to the U.S. patent applications of applicants' Ser. No. 09/832,453 and Ser. No. 09/832,439 applications filed on even date herewith. The contents of these two somewhat related applications are hereby incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

When conducting military operations, and particularly airborne military operations, against an underground hardened target it is often difficult to assess the degree of success achieved in neutralizing the target from further enemy use. The outward manifestations of a "smart bomb" target neutralization that are now familiar to many television viewers (from the video images originating in the early 1990's "Desert Storm" campaign, images wherein a guided bomb is directed into the ventilation shaft of a multi story building and its successful detonation appraised by way of smoke plumes emerging from lower story windows of the building), are often not a usable indicator of intended results when the target is a buried concrete bunker or a munitions magazine or other underground structure. Even in World War II it was common practice to protect such targets with several feet of reinforced concrete (e.g. the German North Sea submarine pens) and to bury this concrete under a sufficient thickness of earth to preclude outward manifestations of an internal munitions detonation event.

In addition to this difficulty arising from the underground and hardened nature of many present day targets it may be appreciated that the gathering of such target damage assessment information is often accomplished from a distant and moving vantage point, i e., from a moving aircraft, an aircraft that has not remained in the target area because of concern for its own safety from ground fire or other hostile threats. Moreover such target damage assessment is often desired in the situation wherein the attacking and assessing aircraft has not been within viewing distance of the target during the entire operation but has remained over the horizon or at some safe distance from the target and its probable defenses during both the weapon launch and success assessment phases of the operation. In any event it is clearly not desirable to require the attack aircraft to either remain in the target vicinity for assessment purposes or for the aircraft to be required to return to the target area for assessment purposes nor especially for a second neutralization attempt-particularly if such a second neutralization is not needed.

Additional considerations in this success assessment sequence include the possible presence of fog, smoke, camouflage, vegetation and other visual assessment hindrances in the region surrounding many targets and the possible use of delayed action or other immediate-signature-absent weapons against certain types of targets. Today of course the gathering of attack success information is also desirably accomplished from even greater distances, i.e., by way of information collected by a satellite in earth orbit; in this instance success assessment is even less reliable if accomplished only by visual means. In solution of these success assessment difficulties it is desirable to use non-visual quantitative information relating to the weapon, especially information relating to events accompany arrival of the weapon at its target, information obtainable from the warhead and its fuze, for success assessment purposes. Such information can be descriptive of events occurring during a brief time interval preceding detonation of the fuze and the warhead charge.

With respect to such non-visual quantitative information it is helpful to realize that in order to achieve most effective neutralization of a hardened target it is desirable for a warhead to detonate only after entering the interior of the target; that is after passing through one or more layers of the target's structure. Moreover to achieve this detonation it is common to provide a hardened target fuze with a capability to respond to events that accompany arrival at the target, events including warhead penetration of successive layers of concrete for example. An accelerometer-based signal may be used for this purpose and may indicate hardened weapon penetration of soil and layers of concrete for example. Other fuze sensors that may be useful in future weapons include devices indicating the presence of living organisms or particular materials in the environment encountered by the fuze.

Although such event-responsive or environment-responsive signal generating capability within present day smart fuze devices serves a useful purpose in supporting a complex fuze detonation algorithm (including for example supporting an algorithm calling for detonation of the fuze after penetrating a predetermined thickness of soil and two layers of concrete) there has heretofore been no practical way to communicate the same data used by the fuze detonation algorithm to persons interested in weapon success assessment (or similarly to persons interested in fuze algorithm development or warhead defense efforts). The present invention is believed to provide a practical and technically viable response to this communications need. In addition to the acceleration signals used in the fuze algorithm, an indication of the fuze detonation event is considered to be useful information for weapon success evaluation and may also be provided by the present invention.

The desirability of obtaining warhead encounter event information back from a deployed munitions device has doubtless been recognized for some time however the accomplishment of such communication has been hindered by challenging practical problems of an operating environment nature. Not the least of these problems is the fact that a hardened target-penetrating warhead may encounter deceleration impulses measuring in the range of twenty thousand to twenty four thousand times the force of gravity in amplitude (20,000–24,000 G's) during penetration of for example a two-foot thick reinforced concrete target layer. FIG. 4 herein shows a drawing made in conformance with U.S. Patent and Trademark Office standards from a photograph of the results of such a penetration accomplished by a small cannon launched hardened target penetration weapon. In FIG. 4 the warhead penetration aperture 400, the target reinforcement bars 402 and the spalling failures 404 and 406 of the concrete at the rear face and front face of the test target 412 are visible. The man represented at 408 in FIG. 4 illustrates relative sizes of the FIG. 4 objects. At least some parts of any target event communication apparatus must endure the forces resulting from the deceleration represented in FIG. 4 and the possibly larger forces present during penetration of an even thicker hardened target; this is of course in addition to the acceleration event forces occurring when the weapon is launched from a cannon or other apparatus on an aircraft or on the ground or elsewhere.

In addition to these acceleration/deceleration forces it is of course clear that receiving communication from a warhead used against an above ground target is one matter however receiving such communication from a warhead directed against an underground or subterranean target is another matter, especially since such communication must occur through tens of feet of earth to be practical, and since this earth may be of widely varying physical and electrical characteristics as is found in for example sandy soils, clay soils, limestone layers and under both wet and dry conditions. In addition to the signal attenuating characteristics of these soils such communications must deal with the loading effect such A materials impose on any antenna used for the communication.

Although subterranean signal propagation has heretofore been used, for examples, in the mining and oil exploration and communication fields, in submarine communications and (perhaps somewhat trivially) in pet yard restraint environments these previous forms of subterranean communication are understood to most often involve operating frequencies, i.e., carrier frequencies, located in the hertz, or kilohertz or few megahertz ranges. Such operating frequencies are of little assistance in resolving the present communication need in view of their long wavelength with respect to the physical sizes of practical warhead devices. Indeed the present invention communication is believed to necessitate use of frequencies in at least the UHF or ultra high radio frequency range in response to this warhead physical size limitation and the need for antenna elements of wavelength-related dimensions located on these warheads. This ultra high radio frequency signal range is also found to afford possible communication "window" electrical characteristics in at least some of the soils contemplated for warhead encounter.

Additional uses of frequencies extending into the microwave region in combination with subterranean antenna elements are also disclosed in the prior art, especially in connection with efforts to extend the useful life of a producing oil well. These uses of radio frequency energy appear largely intended to be of an energy dissipating nature and produce thermal heating of the affected earth components without attempting to communicate information signals.

SUMMARY OF THE INVENTION

The present invention provides a practical arrangement for communicating munitions warhead travel experience-related underground data to a remote location for analysis. The invention uses an ultra high radio frequency subterranean link to a repeater located at or above the earth's surface. The repeater relays the received data to a command center or other selected location by conventional means. The invention addresses questions of signal transmission, communications apparatus hardening and real world environments.

It is an object of the present invention to provide a munitions travel experience history and detonation assurance indications to a remote location analysis center.

It is another object of the invention to provide hardened communication link apparatus capable of surviving in the environment of a hardened target penetration warhead.

It is another object of the invention to provide a subterranean signal communication arrangement usable in a plurality of real world environments.

These and other objects of the invention will become apparent as the description of the representative embodiments proceeds.

These and other objects of the invention are provided by subterranean communicating munitions damage assessment apparatus comprising the combination of:

an obstruction-penetrating munitions warhead having a frontal target engaging portion, a munitions explosive material-container portion and a rearward electrical circuit containment portion;

ultra high radio frequency energy signal generator electrical circuit apparatus contained in a physical shock attenuating suspension in said electrical circuit containment portion of said munitions warhead;

a source of direct current electrical energy contained in physical shock attenuating suspension in said electrical circuit containment portion of said munitions warhead and including energizing connection with said ultra high radio frequency energy generator circuit apparatus;

electrical transducer signal generating apparatus connected to a modulation signal input port of said ultra high radio frequency energy generator circuit apparatus and generating an electrical signal responsive to physical disturbance events attending said munitions warhead;

ultra high radio frequency energy radiating antenna apparatus received in connection with said ultra high radio frequency energy generator electrical circuit apparatus and energized by connection with a signal output port thereof;

portable ultrahigh radio frequency energy signal repeater apparatus having subterranean signal responsive communication link compatibility with said ultra high radio frequency energy generator electrical circuit apparatus;

said portable ultrahigh radio frequency energy signal repeater apparatus being initially contained in segregable connection with said warhead;

control apparatus including an altimeter signal generator connected to commence repeater apparatus segregation from said warhead prior to earth impact.

BRIEF DESCRIPTION OF THE DRAWINGS

The accompanying drawings incorporated in and forming a part of the specification, illustrate several aspects of the present invention and together with the description serve to explain the principles of the invention. In the drawings.

DETAILED DESCRIPTION OF THE INVENTION

Figure 1:
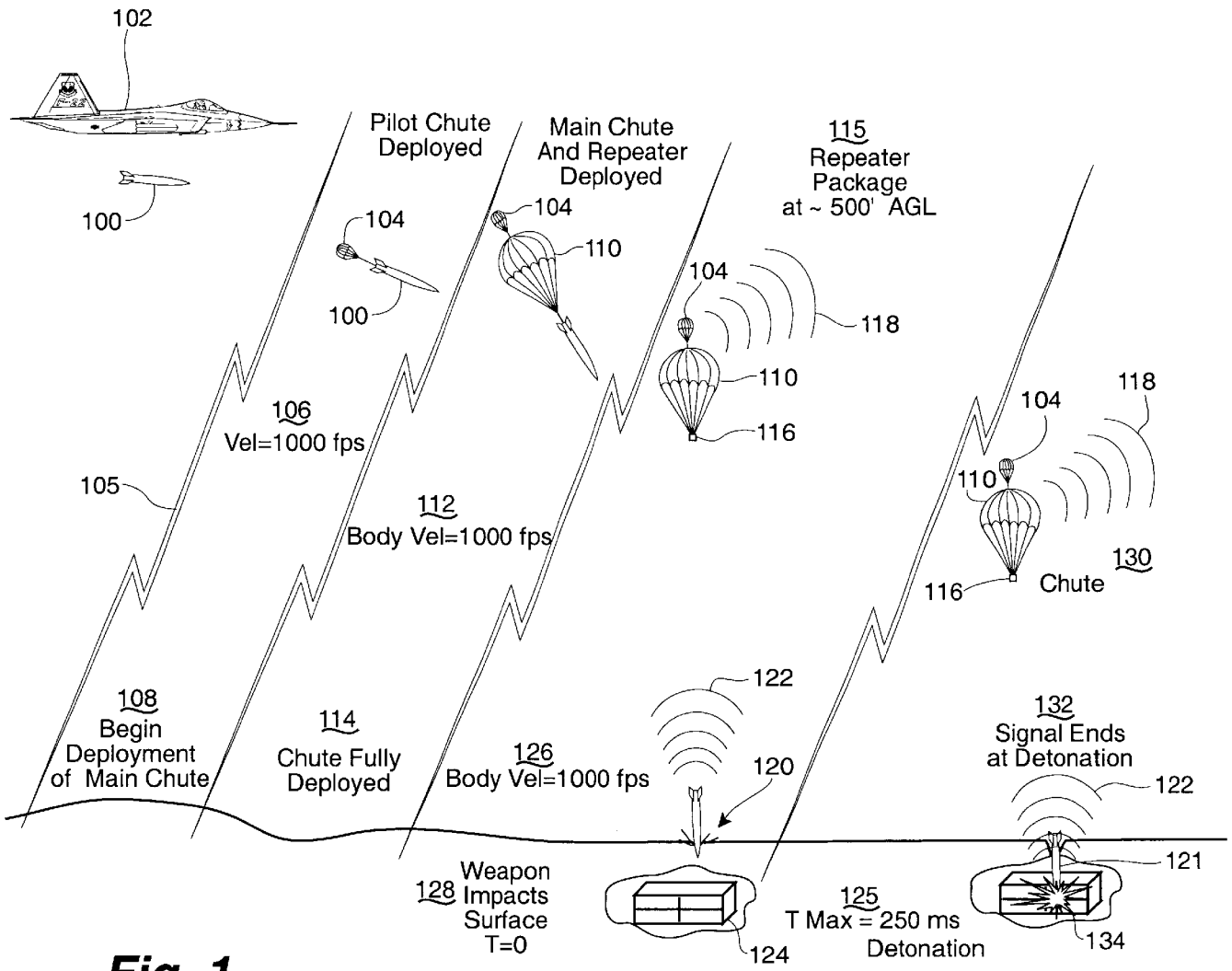
FIG. 1 shows a deployment sequence for a hardened target signal-communicating warhead device according to the present invention.

FIG. 1 in the drawings shows a deployment sequence for a hardened target success signal-communicating weapon device according to the present invention. In the FIG. 1 drawing there is represented a time sequence of events occurring after release of the weapon device 100 by an aircraft 102. Each event in this FIG. 1 sequence is isolated from preceding and succeeding events by the divider symbols 105. Following deployment of the weapon device 100, which may occur at a representative aircraft velocity of 1000 feet per second (682 miles per hour) as indicated at 106, 112 and 126 in the FIG. 1 drawing, an altimeter device 208 in FIG. 2 which becomes exposed beyond the weapon device tail section, may be used to deploy a main parachute 110 in order to separate a radio frequency repeater device 116 (202 in FIG. 2) from the weapon device 100 during its airborne flight phase. As indicated by the weapon device velocity values at 106, 112 and 126 in FIG. 1 the parachutes 104 and 110 are arranged to extract the repeater package while it is airborne rather than to decrease the velocity of the weapon device appreciably. Orientation of the weapon device is provided by a tail kit guidance package in order to attain a penetration attitude substantially normal to the earth's surface and thereby prevent bounce or skip of the weapon device. The purpose of the parachutes 104 and 110 is therefore to extract the repeater with sufficient flight time remaining to receive an ensuing subterranean penetration data history and detonation signal from the penetrating warhead.

Figure 2:
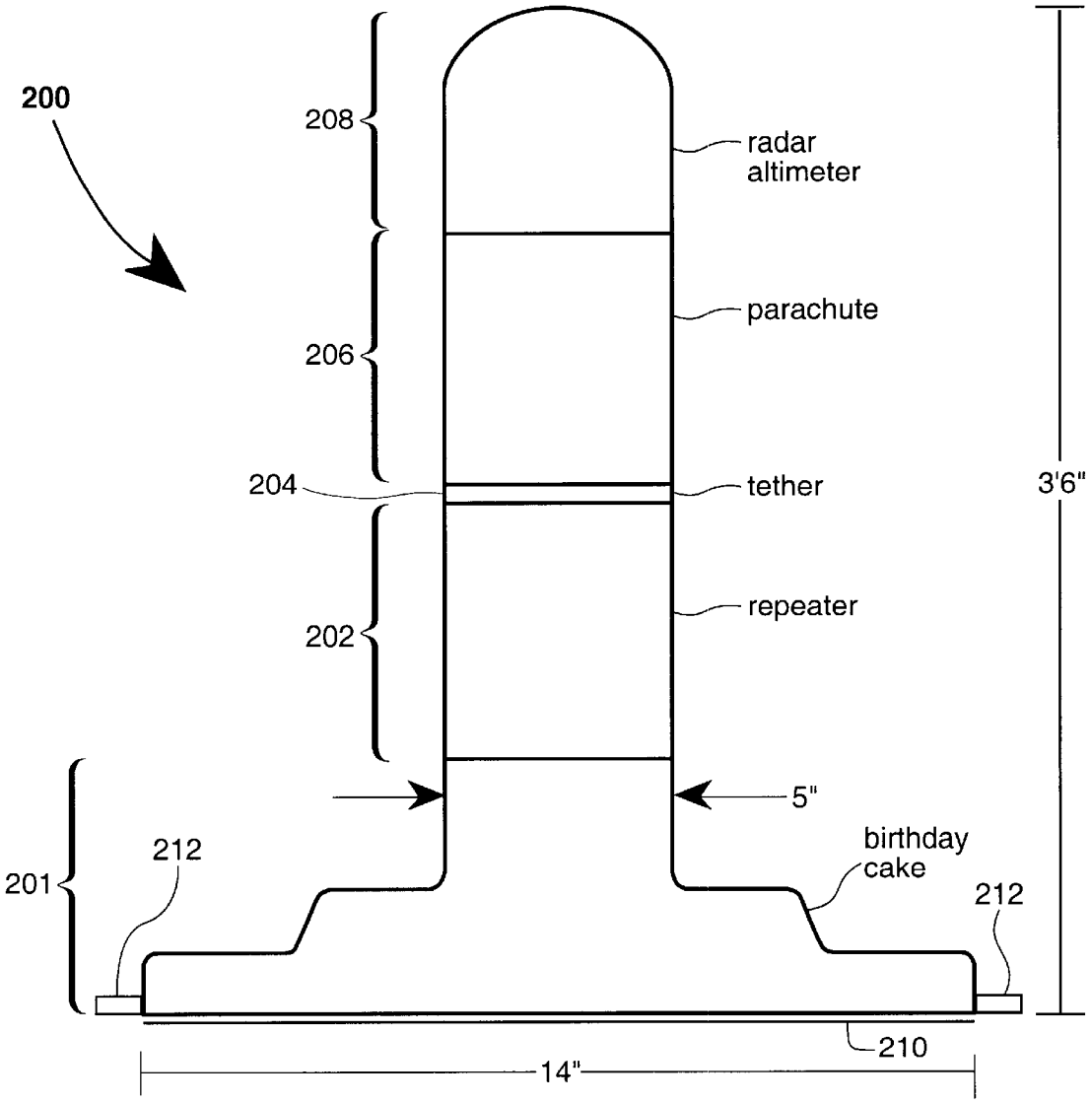
FIG. 2 shows a pre deployment package of components supporting the FIG. 1 sequence.

At some altitude such as the 500 feet indicated at 115 in FIG. 1, the FIG. 2 altimeter 208 jettisons itself allowing a repeater package 116 to be extracted from a rearward cavity of the weapon device 100 while the warhead remainder of the device is allowed to continue with fin guidance toward the impact-penetration event represented at 120 in FIG. 1. Shortly after impact the tail fins are stripped off by penetration thus exposing the tail transmitter of the invention, as it is located in a rearward portion of the weapon device 100. The signals represented at 122 in FIG. 1, are emitted and received in the repeater package 116 and retransmitted at some convenient frequency to a remote location where recording and detailed analysis of the weapon device 100 experiences may be accomplished. Such retransmission may use any of several known techniques including communicating by a telemetry method. The most significant portion of these signals 122 and 118 of course occur commencing with the T=0 weapon to surface impact indicated at 120 in FIG. 1 and ensue for a period such as the 250 milliseconds indicated at 125.

During at least part of the 250 millisecond interval indicated at 125 in FIG. 1 the repeater 116 may remain airborne via the parachutes 104 and 110 in order to achieve efficient communication with a receiver located at a distant mission analysis center; signals of any convenient frequency including microwave, UHF, infrared or other frequencies may be used for this communication. Efficient communication with the penetrating weapon 100 may be assured by tethering the repeater and its parachute to the weapon. The tether will slacken or break at impact allowing the repeater to descend more slowly as it listens and relays data signals from the burrowing transmitter. Alternately in some arrangements of the invention it may also be desirable to locate the repeater on the earth's surface rather than in the air during this communication period. Since the effects of such subterranean signal transmission include communicated signal polarization changes it is desirable for the repeater receiving the subterranean signals to be capable of receiving multiple different signal polarizations without significant signal level attenuation.

During the 250-millisecond interval at 125 in FIG. 1, accelerometer and other desired signals descriptive of the penetration experiences of the weapon device 100 are communicated to the mission analysis center preferably in real time although a delayed communication capability may be incorporated into the repeater 116. These signals may include a final signal indicating energization of or an actual detonation of a faze and a main warhead charge in the weapon device 100 as is represented at 134 in FIG. 1. Variations in the FIG. 1 sequence are of course possible within the scope of the present invention. Such variations may include for example launch of the weapon device 100, or a related device such as a cannon sized device, from a ground-based or airborne cannon, communication of the munitions penetration data to the aircraft pilot or other crewmember or to an aircraft recorder in lieu of or in addition to communication to an analysis center, absence of one or more of the parachutes 104 and 110 and communication of additional or different signals from the weapon device 100. Additional details, particularly details regarding what are believed to be the most unconventional and technically challenging aspects of the FIG. 1 sequence, the subterranean communication and the need for impact-tolerant hardware in the weapon device 100 are disclosed in subsequent portions of this document.

IMPACT TOLERANT HARDWARE

As recited above deceleration forces measuring in the range of 22,000 times the force of gravity have been measured in connection with the impact of the weapon device 100 with the concrete of a buried hardened target as represented at 124 in FIG. 1. Since such impact events precede the occurrence of events providing the most useful information from the weapon device 100, i.e., precede the occurrence of penetrations within the target 124 and the final detonation of the warhead, it is necessary for the communications apparatus accompanying the weapon device 100 to perform during the presence of forces resulting from these decelerations. This requirement is made more complex by the consideration that the most practical location for the communications apparatus is in the rear-most portion of the weapon device 100, a location that can for example experience "tail slap" tri-axial motion during hard impacts. This location however does not interfere with use of a standard munitions guidance kit (such as used for example with the U.S. military's BLU-109 2000 pound class hardened target penetrator bomb in the form of a frequently attached fin kit) with the weapon device 100. This rear most location is also most desirable for accomplishing the subterranean communications represented at 122 in FIG. 1.

FIG. 2 in the drawings shows a physical representation of components usable with the exemplary BLU-109 weapon in performing the FIG. 1 data collected target neutralization sequence. The FIG. 2 components are intended to be located at the rear of for example a BLU-109 weapon, extending backward from the normal rear face of the device and are contained in a cylindrical cavity within the guidance fin kit that is attached to this rear face location on the weapon; this fin kit and the other rearward portions of the FIG. 2 apparatus are not shown in FIG. 2 for the sake of drawing simplicity. The FIG. 2 radar altimeter 208 extends beyond the fins of this kit after they unfold at weapon release. The altimeter jettisons itself, the parachute and the repeater when the remaining altitude provides enough flight time to acquire up to 250 milliseconds of subterranean data from the warhead. The lowermost of the FIG. 2 objects, a "birthday cake" assembly 201, accompanies the BLU-109 weapon through impact and its subterranean antenna, transmitter, and power supply (not shown in FIG. 2) must perform throughout target penetration shocks as is discussed subsequently herein. The FIG. 2 drawing also shows possible outline dimensions for the represented components. Such dimensions include the overall "birthday cake" assembly diameter near 14 inches, a tail cavity diameter of 5 inches for the repeater and other components and an overall height of these components of 3.5 feet.

In the FIG. 2 drawing there is therefore shown an unhardened communications relay or repeater assembly 200 for a weapon such as the BLU-109 device. This unhardened assembly includes power and control apparatus for deploying the repeater and its drag chute at the command of the protruding radar altimeter 208 in FIG. 2. In the FIG. 2 drawing there appears moreover the "birthday cake" assembly 201 in which an impact-hardened weapon to repeater antenna is disposed, a repeater housing module 202 in which the FIG. 1 repeater package 116 is housed, a parachute module 206 in which the FIG. 1 parachutes 104 and 110 are received and an altimeter device module 208 in which a radar altimeter or timer or comparable deployment controlling apparatus is disposed. The FIG. 2 arrangement of components is used to enable the sequence shown in FIG. 1. At 204 in the FIG. 2 drawing is represented a container for the repeater to weapon tether discussed in connection with FIG. 1. At the perimeter of the "birthday cake" assembly a metallic flange 212 by which the FIG. 2 apparatus is attached to the BLU-109 or other weapon is shown. This flange is also used with a restraining ring (not shown) to secure the birthday cake assembly. A ground plane element for the antenna of the "birthday cake" assembly 201 appears at 210 in FIG. 2. Additional details concerning the "birthday cake" assembly 201, including its impact hardening, antenna element configuration and fabrication details are disclosed in the co pending patent application AFD 455A which is first identified above and incorporated by reference herein. The antenna lengthening and impact soil debris-isolating nature of the dielectric resin used to surround the antenna element and to provide impact force resistance are of particular interest in this antenna arrangement.

Figure 3:
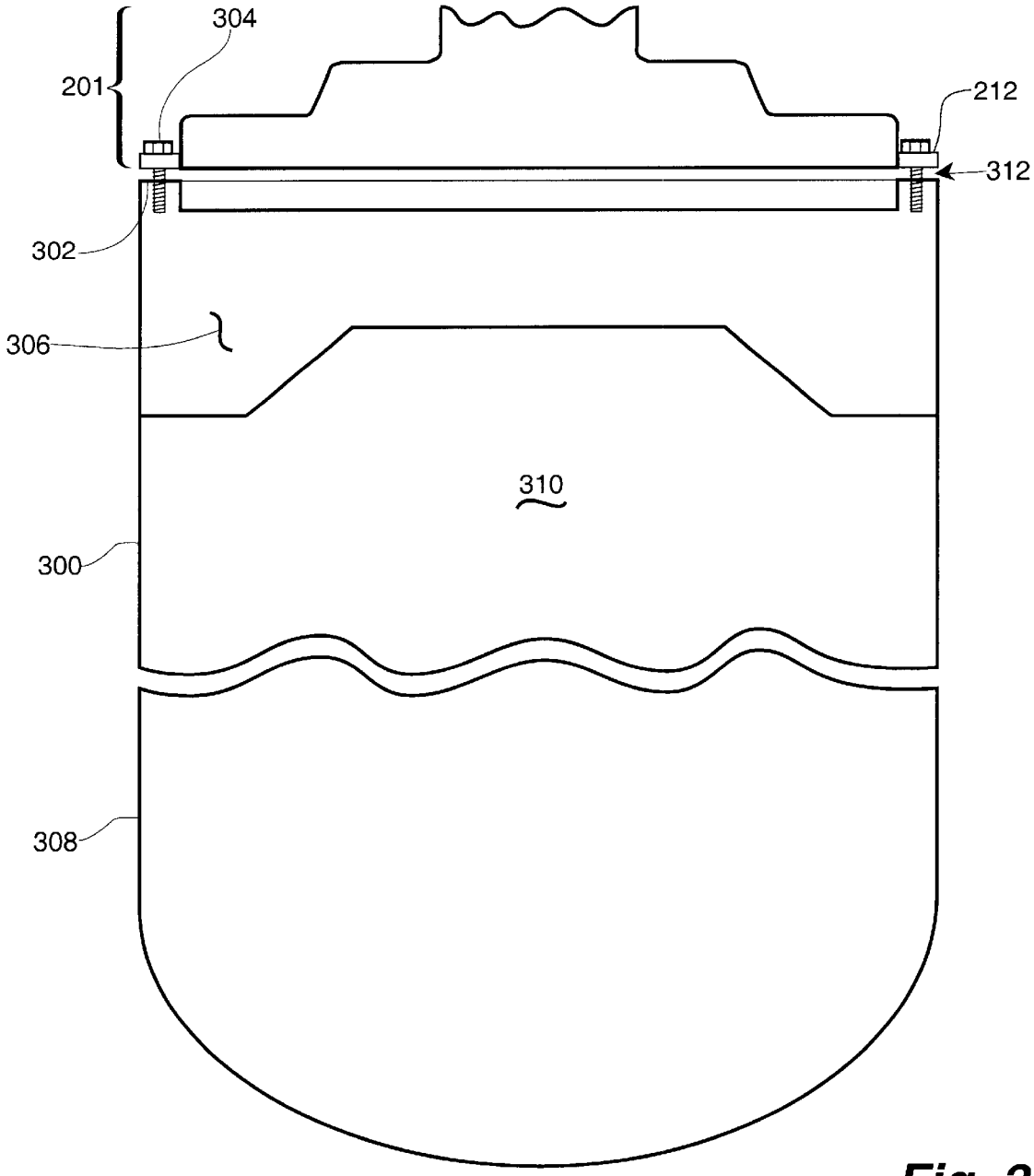
FIG. 3 shows additional details of the FIG. 2 component package.
Figure 4:
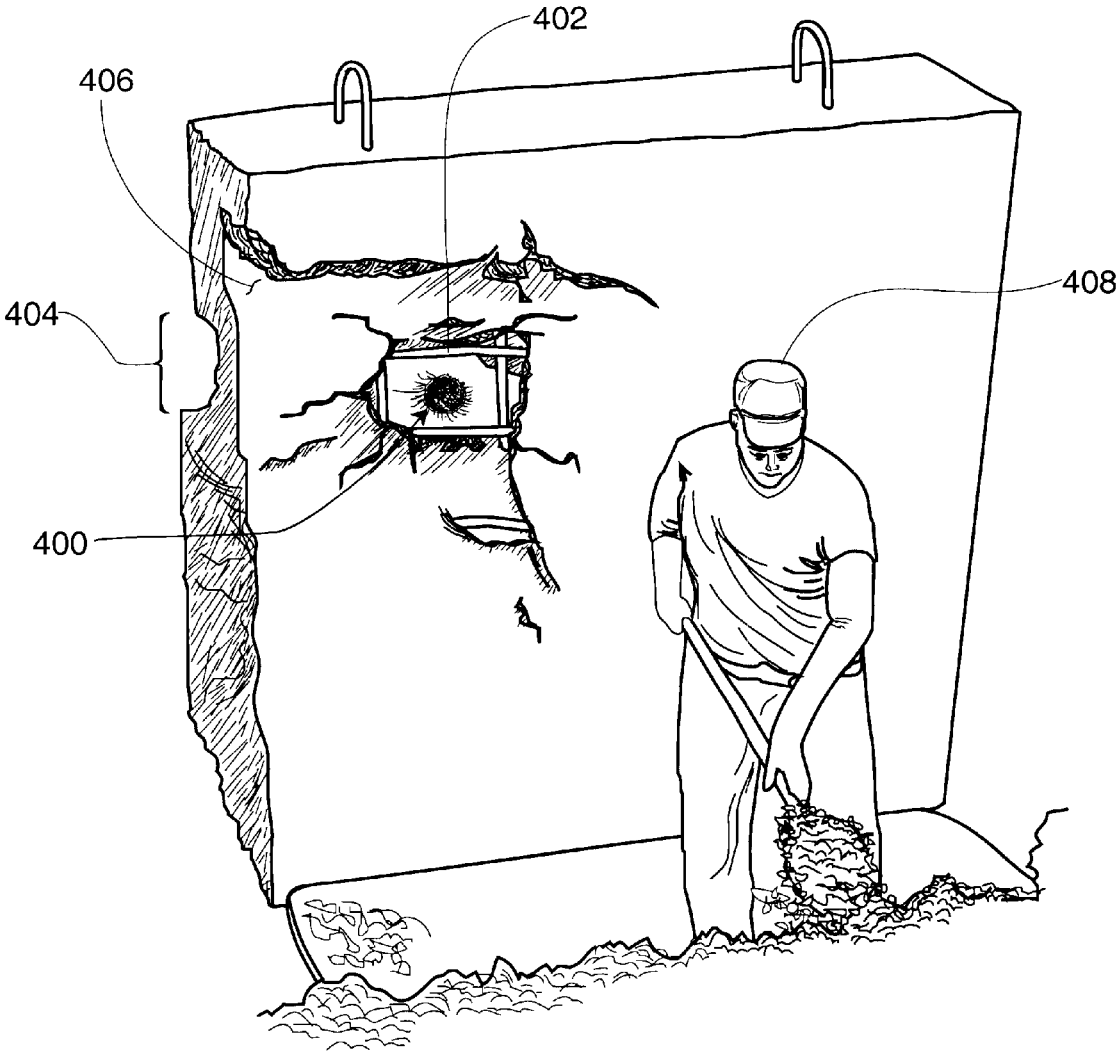
FIG. 4 shows test results from a small hardened target penetration weapon.

FIG. 3 in the drawings shows the manner in which the "birthday cake" assembly lower portions of the FIG. 2 communications assembly 200 may attach to and cooperate with the typical BLU-109 weapon. In the FIG. 3 drawing the rearmost body portion of the BLU-109 weapon appears in a representative cross section outline form at 300. The FIG. 3 drawing omits many details of the BLU-109 weapon since for example it actually incorporates wall thickness dimensions of about one inch and includes components not shown in FIG. 3. The mounting flange 302 comprises the rearmost body portion of the BLU-109; mounting bolts by which the "birthday cake" assembly flange 212 of FIG. 2 attaches to this mounting flange 302 appear at 304. The "birthday cake" assembly 201 is shown to be excessively separated from the flange 302 at 312 in FIG. 3 for drawing clarity purposes. The interior space of the FIG. 3 device at 310 is used to contain munitions explosive material and the frontal portion of the device at 308 comprises a hardened-material, structurally rigid target-engaging portion. The annular inverse pyramidal space at 306 in FIG. 3 may be used to contain an electronics circuit package (an impact-hardened electronics package) for the communications assembly 200 in keeping with a goal that the present munitions success information system be housed outside of the normal confines of the weapon and thereby serve as an electively added refinement to the weapon as needed.

The impact-hardened electronics package for the FIG. 3 device may include integrated circuit and discrete transistor electronic devices packaged in the manner described in the above identified and incorporated by reference herein co pending patent application AFD456 and additional impact hardening techniques. These impact-hardened devices include a battery energy source, hardened oscillator, half watt keyed amplifier, a 20 watt discrete transistor driver and a discrete transistor radio frequency power amplifier operating in the range of 200 watts of radio frequency energy output in accordance with data disclosed in the following topic of this document. A ground plane portion of the communications assembly 200 appears at 210 in the FIG. 2 drawing; this ground plane is actually disposed at the lower face of the assembly without the intervening gap shown for clarification purposes in FIG. 2.

In contrast with the invention of the above identified U.S. patent application of applicants' docket number AFD456 it is desirable for the radio frequency signals of the present invention apparatus to remain continuous and active throughout a penetration event sequence. Interruption of these signals by a spike of deceleration force for example, although undesirable, may be acceptable in the case of the locator beacon device of the Ser. No. 09/832,439 document but not in the present data communication instance.

SUBTERRANEAN COMMUNICATIONS

The buried hardened target penetration represented at 121 in the FIG. 1 drawing is an event of great interest in performing a success assessment for the FIG. 1 sequence. The time delay between earth penetration at 120 and arrival at target 124, the delay occurring during an early part of the 250 millisecond interval recited at 125 in FIG. 1, together with the force magnitude and duration of each of the first, second and subsequent impact events and the special signal generated at warhead detonation, are particularly significant events in a success analysis of the FIG. 1 sequence. Collecting signals descriptive of these several events implies the need for communication through a lengthening subterranean path from the penetrating weapon while it is moving through the earth and the target hardening layers. Subterranean communication of this nature has heretofore been accomplished while using lower frequency-disposed portions of the radio frequency spectrum as disclosed above herein. In the present instance however the physical dimensions of practical weapons are incompatible with the efficient antenna lengths needed for these lower frequency communications and resort to frequencies in the ultra high radio frequency range is believed desirable. The subterranean use of such frequencies appears however to have in the past been limited to intentionally energy dissipative instances wherein ground heating for oil production or other purposes is desired or instances wherein subterranean measurements are being made for example for mineral exploration purposes.

Figure 5:
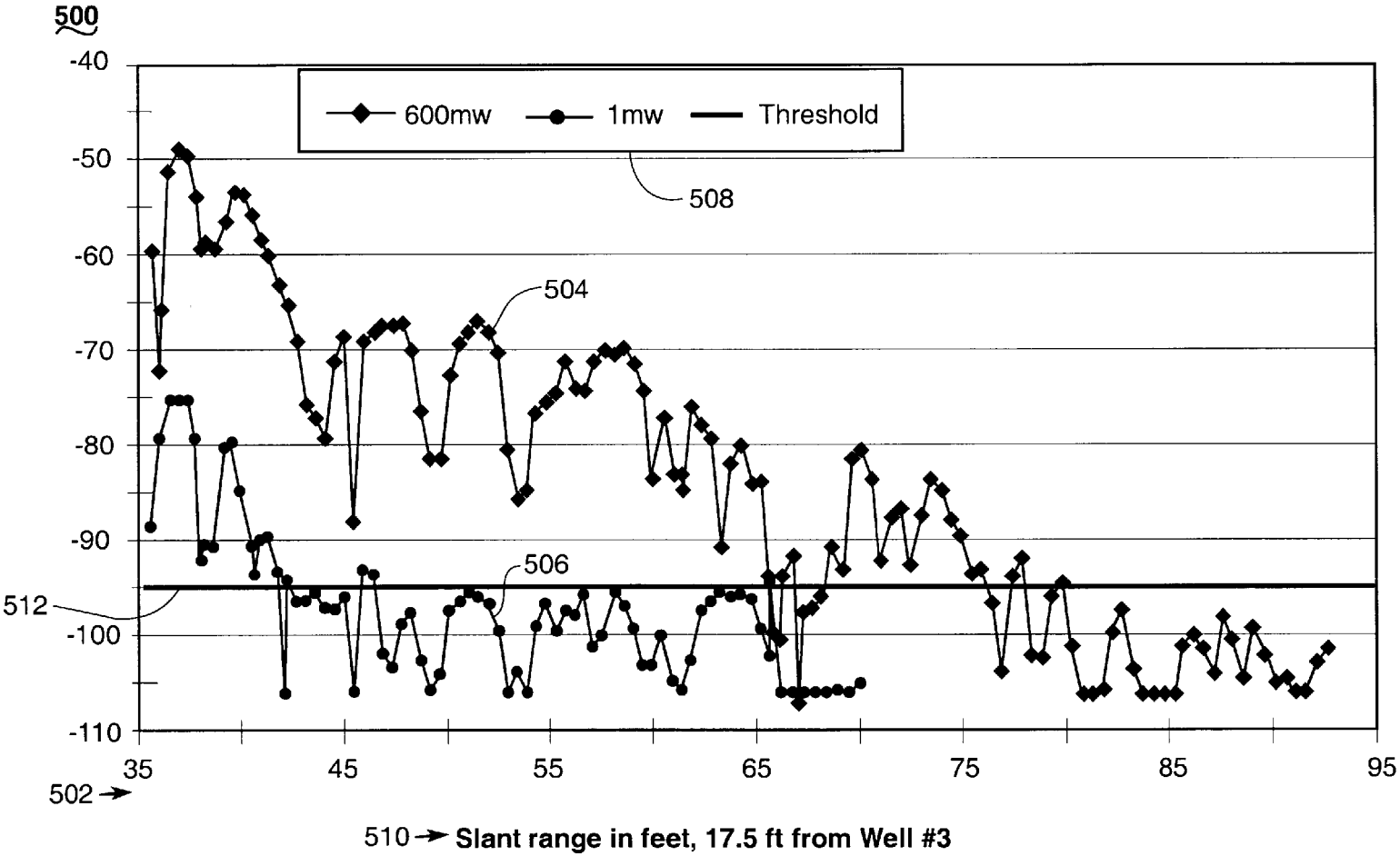
FIG. 5 shows subterranean signal transmission characteristics relating to the invention.

We have accomplished measurements indicating however that communication at ultra high radio frequencies is possible through a subterranean path at least to a degree sufficient to support the present weapon data communication need. FIG. 5 in the drawings illustrates the results of a portion of these measurements conducted in a grout-lined plastic piped well in sandy Florida soil and at a frequency in the 300-megahertz ultra high radio frequency range. In the FIG. 5 drawing the vertical scale at the left represents signal strength with respect to a one-milliwatt reference and the horizontal scale at 502 represents length of the slant range subterranean path. The well providing the FIG. 5 data comprises a 2-inch diameter PVC pipe lined with one inch of concrete grout to a depth beyond the 90 ft water table. Signal strength measurements for one and 600-milliwatt transmitters are taken as each transmitter is lowered toward the water table. As indicated at 510 in the FIG. 5 drawing the point of received signal measurement is located at a horizontal distance of 17.5 feet from the well opening into the earth. Depths beyond 35 feet are believed to preclude significant air path transmission of test signals from the buried antenna that would emerge from points less than the 17.5 ft radial previously discussed. The uppermost curve at 504 in FIG. 5 represents measurements made with a transmitter input power of 600 milliwatts and the lower curve at 506 with an input power of 1 milliwatt. The horizontal line at 512 in FIG. 5 represents the −96 dBm signal strength sensitivity threshold of an ASH receiver of the type described later herein (the FIG. 5 test signals are received using a signal integrating spectrum analyzer of roughly −135 dBm sensitivity). Under these conditions therefore FIG. 5 signals above the receiver threshold line 512 represent successful communications from the subterranean antenna.

Notably even with the modest power levels shown in FIG. 5 (power levels summarized at 508 in FIG. 5) subterranean UHF communication over path lengths of 40 and 65 feet are reasonably feasible. In order to accommodate greater distances between a subterranean antenna and the contemplated above ground repeater/receiver, and to accommodate soil conditions perhaps less favorable to signal conveyance, greater power levels, levels in the range of 200 watts of radio frequency power, are preferred for the warhead transmitter. Use of the repeater represented at 116 in the FIG. 1 drawing and the repeater location-determining tether 204 in FIG. 2 are accommodations of the attenuated ultra high radio frequency signal transmission achieved through various soil and target types to be expected during operational use of the present invention data collection invention. Under the most favorable conditions contemplated it may be possible to omit the repeater apparatus 116 and rely on direct warhead to analysis-location transmission however presently available data suggests this is a very limited possibility.

UHF transmitter output power in the 250-watt range may be obtained for example with the use of a Motorola MRF 275G ceramic field effect transistor as a final radio frequency amplifier stage. A one time "Thermal Battery" such as the EAP-12181 battery manufactured by the Eagle Picher Corporation may be used as an energy source of this capability (over the milliseconds short operating time needed) for the warhead transmitter. Batteries of this type may be used to energize a twenty-four volt, fifteen-ampere load for a period of 250 milliseconds for example. Batteries of this type are provided with an electro-thermally removable internal seal maintaining the reactive components in a separated condition until an externally sourced electrical activation signal is applied to the battery to rupture the seal, commence the exothermic chemical reaction and initiate the production of electrical energy. A pull pin upon weapon launch from the aircraft may provide the activation signal for the transmitter and repeater power and the altimeter. The activation signal for the warhead transmitter (the birthday cake transmitter) power may be provided by the altimeter signal that extracts the repeater from the tail kit or from impact with the earth.

The "birthday cake" assembly transmitter may be operated at a low power level when the repeater is first extracted in air and operated at the higher power level upon earth impact in order to conserve energy and yet overcome the greater signal losses encountered with soil and target penetration. Following a similar line of reasoning the "birthday cake" assembly transmitter may be specially tuned for maximum efficiency in a soil and debris environment where the signal absorption is greatest. Such a less efficient-in-air arrangement offers the additional advantage that the receiver sensitivity does not have to change as dramatically when the transmitter is suddenly buried. Custom tailoring of the battery to fit in the space 306 or a comparable space in another weapon/communications apparatus package and to tolerate impact deceleration forces is appropriate. Data signals of the deceleration measurement type and other types as generated in the weapon fuze and described above herein may be applied to a modulation input port of the transmitter.

Several arrangements for generating data signals of the deceleration measurement type and other types in the weapon fuze are found in the series of Patents including the following:

U.S. Pat. No. 5,255,608 issued to K. S. Min
U.S. Pat. No. 4,375,192 issued to Yates et al.
U.S. Pat. No. 4,455,939 issued to Munzel.
U.S. Pat. No. 4,480,550 issued to Abt
U.S. Pat. No. 4,580,498 issued to Abt et al.
U.S. Pat. No. 4,638,130 issued to Grössler et al.
U.S. Pat. No. 4,667,598 issued to Gröbler et al.
U.S. Pat. No. 4,694,752 issued to Titus
U.S. Pat. No. 4,703,693 issued to Spies et al.
U.S. Pat. No. 4,799,427 issued to Held et al.

These patents are also hereby incorporated by reference herein.

Although conventional radio frequency energy receiver apparatus may be used to embody the receiver portion of the repeater 116 in FIG. 1 we have found that improved results including greater weak signal sensitivity (e.g. −92 dBm) and wider signal dynamic range acceptance characteristics may be obtained with use of the ASH (amplifier-sequenced hybrid) receiver arrangement that is available from the RF Monolithics, Incorporated company of Dallas, Tex. This receiver is available in the form of a small package, low operating voltage and current integrated circuit of "RX1120" nomenclature for example for use in the 300 megahertz UHF range. Receivers of this type are based on the principle of segregating an employed unusually large degree of signal amplification into plural segments. These amplifier segments are isolated by a signal time delay element (usually accomplished with a surface acoustic wave, or SAW, delay line) in order that the large degree of amplification employed operates in time sequence and thereby avoid amplifier oscillation.

The direct conversion—energy packet acceptance reception accomplished in the ASH receiver, as opposed to conventional superhetrodyne—envelope detection, is a notable aspect of the present invention and is supported by believed to be new knowledge of the phase and wave polarization anomalies caused by radiating radio frequency energy signals through soil. Soil properties can for example destroy envelope accuracy but only attenuate energy packets. Soil effects may also change signal polarization; these effects suggest the use of repeater 116 reception of multi polarization capability. Moreover in addition to and in extension of the transmitter power level changes discussed above, in connection with battery considerations, the transmitter-antenna efficiency in the present invention "birthday cake" assembly may also be specially tailored for greatest efficiency in dense media in order that less power is radiated in light media where losses are lower. Such arrangement additionally moderates the rate at which the repeater 116 receiver gain must react to the drastic changes in attenuation represented in FIG. 5. In this regard it is interesting to appreciate that the weapon device 100 traverses the FIG. 5 attenuation curve in the early part of the 250 milliseconds interval recited at 125.

With respect to repeater 116 receiving signals of differing polarization, it is likely that, in addition to signal polarization changes attributed to communication through paths of changing subterranean length and changing subterranean media content, this communication may also involve a spinning or otherwise moving repeater receiver since the repeater can be suspended in the air during the period of most relevant data transmission. For such signal diversity reception conditions a receiver coupled to a single multiple polarization-responsive antenna or to a plurality of differing polarization-responsive antennas may be used in the repeater 116. A more practical arrangement for this receiver however appears to call for use of a plurality of different receiver circuits, three receiver circuits for example, with each such receiver circuit coupled to an antenna of differing signal polarization preference. In view of the small size and relatively low cost of the preferred ASH receivers the increased complexity thus imposed appears justified.

Receivers of the ASH type are described in several U.S. Patents including the U.S. Pat. Nos. 4,454,488; 4,616,197; 4,749,964; 4,92,925 and others pending at the 1994 time of printing the RF Monolithics catalog available during preparation of this document. Most of these and other RF Monolithics Inc. (and indeed certain other Texas corporation) patents involve the name of one Darrell L. Ash as an inventor. The contents of these patents are also hereby incorporated by reference herein. Additional information concerning the ASH receiver, its unusually high sensitivity, unusual dynamic range and its incorporation into useful apparatus is disclosed in the RF Monolithics Inc publication "ASH Transceiver Designer's Guide" (also hereby incorporated by reference herein) one version of which is identified as updated 2001.01.11. This and additional relevant technical information are also available by way of a RF Monolithics internet home page, currently at http://www.rfm.com/.

In summary, the disclosed hardened target penetrator weapon system deploys a receiver repeater deployed before weapon impact and a warhead transmitter capable of surviving impact and shocks during soil and buried target penetration. The transmitter sends target properties and fuze performance information to the deployed repeater receiver for retransmission to an analysis or command center. The target and fuze information ultimately reduce the increased risk to pilots associated with repeated target strikes and also provide data to enhance future weapon developments.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

We claim:

1. Subterranean communicating munitions damage assessment apparatus comprising the combination of:

an obstruction-penetrating munitions warhead having a frontal target engaging portion, a munitions explosive material-container portion and a rearward electrical circuit containment portion;

ultra high radio frequency energy signal generator electrical circuit apparatus contained in a physical shock attenuating suspension in said electrical circuit containment portion of said munitions warhead;

a source of direct current electrical energy contained in physical shock attenuating suspension in said electrical circuit containment portion of said munitions warhead and including energizing connection with said ultra high radio frequency energy generator circuit apparatus;

electrical transducer signal generating apparatus connected to a modulation signal input port of said ultra high radio frequency energy generator circuit apparatus and generating an electrical signal responsive to physical disturbance events attending said munitions warhead;

ultra high radio frequency energy radiating antenna apparatus received in connection with said ultra high radio frequency energy generator electrical circuit apparatus and energized by connection with a signal output port thereof;

portable ultrahigh radio frequency energy signal repeater apparatus having subterranean signal responsive communication link compatibility with said ultra high radio frequency energy generator electrical circuit apparatus;

said portable ultrahigh radio frequency energy signal repeater apparatus being initially contained in segregable connection with said warhead;

control apparatus including an altimeter signal generator connected to commence repeater apparatus segregation from said warhead prior to earth impact.

2. The subterranean communication munitions damage assessment apparatus of claim 1 wherein said obstruction-penetrating munitions warhead is a hardened target-penetrating warhead.

3. The subterranean communication munitions damage assessment apparatus of claim 1 wherein said portable ultrahigh radio frequency energy signal receiving apparatus comprises a diversity set of receivers and a retransmitting repeater apparatus.

4. The subterranean communication munitions damage assessment apparatus of claim 1 wherein said source of direct current electrical energy comprises an electrically initiated battery.

5. The subterranean communication munitions damage assessment apparatus of claim 1 wherein said electrical transducer signal generating apparatus comprises an accelerometer element.

6. The subterranean communication munitions damage assessment apparatus of claim 5 wherein said accelerometer element and said modulation signal are disposed in a fuze portion of said munitions warhead.

7. The subterranean communication munitions damage assessment apparatus of claim 1 wherein said ultra high radio frequency energy radiating antenna apparatus comprises a fractional wavelength antenna element embedded in an impact tolerant material and disposed in a rearmost portion of said munitions warhead.

8. The subterranean communication munitions damage assessment apparatus of claim 1 further including tether apparatus capable of positioning said portable subterranean signal responsive ultrahigh radio frequency energy signal receiving apparatus within signal reception distance of a target impact subterranean burial point of said munitions warhead.

9. The subterranean communication munitions damage assessment apparatus of claim 1 wherein said tether apparatus is capable of positioning said portable ultrahigh radio frequency energy signal repeater apparatus within signal reception distance of a target impact subterranean burial point during both airborne and subsequent earth impact time intervals of said signal repeater apparatus.

10. The subterranean communication munitions damage assessment apparatus of claim 1 wherein said portable ultrahigh radio frequency energy signal receiver apparatus includes an amplifier sequenced hybrid ultra high radio frequency radio receiver and a multiply polarized antenna.

11. The method for communicating munitions warhead earth and target penetration events descriptive information to a remote location comprising the steps of:

disposing an ultra high radio frequency receiver apparatus within receiving range of an earth impact event of said munitions warhead;

communicating warhead deceleration related signals from a force responsive transducer accompanying said warhead during said earth impact event to an ultra high radio frequency signal generating electrical circuit apparatus also accompanying said warhead during said earth impact event;

said communicated warhead deceleration signals modulating an output signal of said ultra high radio frequency signal generating circuit apparatus with transducer electrical signals representative of warhead penetration event deceleration signals;

communicating ultra high radio frequency warhead penetration event deceleration signals from successive earth and target penetration locations of said warhead to said disposed ultra high radio frequency receiver apparatus via a warhead transmitting antenna;

said warhead transmitting antenna communicating radio frequency signals through a subterranean warhead to receiver path of changing length and orientation during said successive earth and target penetration locations following warhead to earth impact;

maintaining a usable loading efficiency in said ultra high radio frequency transmitting antenna element, notwithstanding changing antenna loading effects encountered during said subterranean path successive earth and target penetration locations;

relaying signals representative of said warhead deceleration event signals from said disposed ultra high radio frequency receiver apparatus to a remote signal analysis location.

12. The method for communicating munitions warhead penetration events descriptive information to a remote location of claim 11 wherein said step of disposing an ultra high radio frequency receiver apparatus within receiving range of an earth impact event of said munitions warhead includes the step of tethering said ultra high radio frequency receiver apparatus to said munitions warhead during a pre impact flight interval of said receiver apparatus.

13. The method for communicating munitions warhead penetration events-descriptive information to a remote location of claim 11 wherein said step of communicating warhead deceleration related signals from a force responsive transducer accompanying said warhead during said earth impact event further includes communicating warhead detonation-related signals from said warhead to said radio frequency receiver apparatus along said subterranean warhead to receiver path.

14. The method for communicating munitions warhead penetration events descriptive information to a remote location of claim 11 wherein said step of communicating ultra high radio frequency warhead penetration event deceleration signals from successive penetration locations of said warhead to said disposed ultra high radio frequency receiver apparatus via a warhead transmitting antenna includes transmitting said ultra high radio frequency signals at a power level of two-hundred, fifty watts.

15. The method for communicating munitions warhead penetration events descriptive information to a remote location of claim 11 wherein said step of maintaining a usable loading efficiency in said ultra high radio frequency transmitting antenna element, notwithstanding changing antenna loading effects encountered during said subterranean path successive earth and target penetration locations includes maintaining selected minimum physical separations between elements of said antenna and a debris region attending said warhead during said earth penetration event.

16. The method for communicating munitions warhead penetration events descriptive information to a remote location of claim 11 wherein said step of maintaining a usable loading efficiency in said ultra high radio frequency transmitting antenna element, notwithstanding changing antenna loading effects encountered during said subterranean path successive earth and target penetration locations includes initial dielectric loading of said antenna in response to selected predetermined dielectric loading effects.

17. The method for communicating munitions warhead penetration events descriptive information to a remote location of claim 11 wherein said step of relaying signals representative of said warhead deceleration event signals includes retransmitting said warhead penetration events descriptive information signals on a different radio frequency.

18. The method for communicating munitions warhead penetration events descriptive information to a remote location of claim 11 wherein said step of disposing an ultra high radio frequency receiver apparatus within receiving range of an earth impact event of said munitions warhead includes disposing an amplifier sequenced hybrid ultra high radio frequency radio receiver within a worst case reception distance of said earth impact event.

19. The method for communicating munitions warhead penetration events descriptive information to a remote location of claim 11 wherein said step of modulating an output signal of said ultra high radio frequency signal generating circuit apparatus includes amplitude modulating said output signal and wherein said step of disposing an ultra high radio frequency receiver apparatus within receiving range of an earth impact event of said munitions warhead includes disposing an amplifier sequenced hybrid ultra high radio frequency radio receiver within reception distance of said earth impact event.

20. The method for communicating munitions warhead penetration events descriptive information to a remote location of claim 11 further including the step of selecting characteristics of said warhead transmitting antenna to increase radiation therefrom in proportion to radio frequency energy absorptive characteristics of media traversed during said earth penetration.

21. The method for communicating munitions warhead penetration events descriptive information to a remote location of claim 11 wherein said step of communicating ultra high radio frequency warhead penetration event deceleration signals to said ultra high radio frequency receiver apparatus includes receiving said communicated signals via a multiple wave polarized receiving antenna array.

22. The method for communicating munitions warhead penetration events descriptive information to a remote location of claim 21 wherein said step of receiving said communicated signals via a multiple wave polarized receiving antenna array includes receiving said signals by way of separate receiver antennas for each possible received signal polarization.

23. The method for communicating munitions warhead penetration events descriptive information to a remote location of claim 11 wherein said step of relaying signals representative of said warhead deceleration event signals from said disposed ultra high radio frequency receiver apparatus to a remote signal analysis location includes communicating said signals by a telemetry method.

24. Subterranean communicating munitions damage assessment apparatus comprising the combination of:

an obstruction penetrating munitions warhead having a frontal target engaging portion, a munitions explosive material-container portion and a rearward electrical circuit containment portion;

ultra high radio frequency energy signal generator electrical circuit apparatus received in physical shock attenuating suspension in said electrical circuit containment portion of said munitions warhead;

a source of direct current electrical energy received in physical shock attenuating suspension in said electrical circuit containment portion of said munitions warhead and including energizing connection with said ultra high radio frequency energy generator circuit apparatus;

electrical transducer signal generating apparatus connected with a modulation signal input port of said ultra high radio frequency energy generator circuit apparatus and generating an electrical signal responsive to physical disturbance events attending said munitions warhead;

ultra high radio frequency energy radiating antenna apparatus received in connection with said warhead and energized by connection with a signal output port of said ultra high radio frequency energy generator electrical circuit apparatus;

portable ultrahigh radio frequency energy signal receiving apparatus having subterranean signal responsive communication link compatibility with said ultra high radio frequency energy generator electrical circuit apparatus;

said portable ultrahigh radio frequency energy signal receiving apparatus being initially contained in interruptible connection with said warhead.

* * * * *